US010323413B1

(12) United States Patent
Biesiadecki

(10) Patent No.: US 10,323,413 B1
(45) Date of Patent: Jun. 18, 2019

(54) BUILDING PANEL STRUCTURE AND METHOD OF MANUFACTURING THEREOF

(71) Applicant: John Biesiadecki, Sycamore, IL (US)

(72) Inventor: John Biesiadecki, Sycamore, IL (US)

( * ) Notice: Subject to any disclaimer, the term of this patent is extended or adjusted under 35 U.S.C. 154(b) by 0 days.

(21) Appl. No.: 15/912,624

(22) Filed: Mar. 6, 2018

Related U.S. Application Data

(63) Continuation-in-part of application No. 15/485,520, filed on Apr. 12, 2017, now Pat. No. 9,920,527.

(60) Provisional application No. 62/503,467, filed on May 9, 2017.

(51) Int. Cl.

| | |
|---|---|
| ***E04B 1/14*** | (2006.01) |
| ***E04B 2/00*** | (2006.01) |
| ***E04C 2/32*** | (2006.01) |
| ***E04C 2/288*** | (2006.01) |
| ***E04C 2/292*** | (2006.01) |

(52) U.S. Cl.
CPC ..... *E04C 2/288* (2013.01); *E04C 2/292* (2013.01); *E04C 2/322* (2013.01); *E04C 2/46* (2013.01); *E04B 1/14* (2013.01)

(58) Field of Classification Search
CPC ..... E04C 2/284; E04B 1/7608; E04B 1/762; E04B 1/14; E04B 2002/0202
See application file for complete search history.

(56) References Cited

U.S. PATENT DOCUMENTS 3,295,278 A * 1/1967 Muhm ..... E04C 2/044 264/256
3,884,009 A * 5/1975 Frohlich ..... E04D 11/02 52/302.1
4,189,886 A * 2/1980 Frohlich ..... E04D 7/00 52/302.1
5,787,668 A * 8/1998 Carkner ..... E04D 11/02 52/302.1
5,809,723 A * 9/1998 Keith ..... E04C 2/288 411/475
6,167,624 B1 * 1/2001 Lanahan ..... B26D 1/553 264/142
6,176,920 B1 * 1/2001 Murphy ..... B28B 1/093 106/711
6,584,749 B2 * 7/2003 Sperber ..... E04B 1/7604 52/404.1
7,543,419 B2 * 6/2009 Rue ..... E04C 2/22 52/309.16

(Continued)

FOREIGN PATENT DOCUMENTS

GB 2055326 A * 3/1981 ..... B32B 27/08

*Primary Examiner* — Rodney Mintz
(74) *Attorney, Agent, or Firm* — Steven H. Greenfield; "Greenfield Invention and Patent Consulting Inc."

(57) ABSTRACT

A building panel structure and a process for manufacturing the structure are disclosed. The structure comprises a concrete layer disposed on the outside of a building, an insulating material comprising polyurethane in the center of the structure and a corrugated steel layer on the inside of the building. A reinforcing assembly comprising an upper channel and a lower channel that are connected using a plurality of studs is embedded inside the building panel structure. The process of manufacturing the building structure comprises placing a wet concrete layer inside a container, positioning the reinforcing assembly in the container inside the wet concrete, setting the concrete layer and forming the polyurethane layer between the concrete and corrugated steel layers by an in-situ chemical reaction.

12 Claims, 14 Drawing Sheets

(56) References Cited

U.S. PATENT DOCUMENTS 8,555,584 B2 * 10/2013 Ciuperca ..... E04B 1/355 52/309.12
8,733,046 B2 * 5/2014 Naidoo ..... E04B 1/14 52/309.16
9,151,053 B2 * 10/2015 Stephens, Jr. ..... E04C 2/52
9,279,075 B2 * 3/2016 Parker ..... C04B 28/10
9,303,404 B2 * 4/2016 Naito ..... E04C 2/46
9,725,902 B1 * 8/2017 Chugh ..... E04B 1/90
9,920,527 B1 * 3/2018 Biesiadecki ..... E04C 2/284
9,920,528 B1 * 3/2018 Biesiadecki ..... E04C 2/284
2002/0112442 A1 * 8/2002 Sperber ..... E04B 1/7604 52/742.1
2007/0245657 A1 * 10/2007 Valle ..... E04C 2/28 52/356
2008/0104913 A1 * 5/2008 Messenger ..... E04C 2/288 52/309.9
2011/0008624 A1 * 1/2011 Roseeuw ..... A47B 96/206 428/411.1
2012/0216476 A1 * 8/2012 Naidoo ..... E04B 1/14 52/309.4
2012/0291384 A1 * 11/2012 Martens ..... E04C 2/386 52/309.1
2013/0034732 A1 * 2/2013 Parker ..... C04B 28/10 428/402
2013/0067838 A1 * 3/2013 Black ..... E04C 2/22 52/220.7
2013/0133277 A1 * 5/2013 Lewis ..... E04B 1/7675 52/220.1
2013/0283713 A1 * 10/2013 Martens ..... E04C 2/284 52/309.1
2014/0033627 A1 * 2/2014 Stephens, Jr. ..... E04C 2/52 52/204.5
2016/0010330 A1 * 1/2016 Naito ..... E04C 2/46 52/405.2

* cited by examiner

BUILDING PANEL STRUCTURE AND METHOD OF MANUFACTURING THEREOF

RELATED APPLICATIONS

This application claims priority from provisional application 62/503,467 filed on May 9, 2017 and is a continuation in part of U.S. patent application Ser. No. 15/485,520 filed on Apr. 12, 2017.

FIELD OF THE INVENTION

The present invention relates to a prefabricated building panel that provides high insulation value and rigidity. The building panel of the present invention may be made in a wide range of sizes and is configured for positioning and transportation on flatbed trucks. The building panel is suitable for any size building including commercial, institutional, residential and industrial.

BACKGROUND OF THE INVENTION

Current art building panels are typically manufactured in three layers: a concrete layer that faces to the outside of the building, a concrete layer that faces to the inside of the building and an insulation layer in between. Typical insulating materials that are used in these panels include polyisocyanurate or polystyrene loosely sandwiched between the two concrete layers. Typical R values for this type of a panel range between about 4/inch to about 8/inch.

The structures made of two layers of concrete and loose foam insulation generally have high compression strength, but lack tensile and shear strength. This makes the panels susceptible to delamination from shearing forces such as due to high winds. Concrete also has a tendency to crack or shatter from the impact of blunt force.

Heating or cooling losses resulting from the use of low insulation values of typical panels used in all buildings can be significant. It would be, therefore, be desirable to use building panels in all construction that have high insulation value in the range of about 30/inch to about 40/inch and even higher, yet have high compressive strength, tensile strength, shearing strength and bending rigidity to withstand high winds, withstand the high vertical loads exerted by roofs and floors, and maintain integrity while being hoisted, loaded onto trucks and transported.

SUMMARY OF THE PRESENT INVENTION

In one aspect of the present invention, a reinforcing assembly for a wall panel structure contains an upper channel containing a) a first plate, b) a first vertical member attached to a first longitudinal side of the first plate, the b) being downwardly disposed, and c) a second vertical member attached to a second longitudinal side of the first plate, the c) being downwardly disposed; a lower channel containing d) a second plate, e) a first vertical member attached to a first longitudinal side of the second plate, the e) being upwardly disposed, and f) a second vertical member attached to a second longitudinal side of the second plate, the f) being upwardly disposed; a first plurality of studs, the each stud of the first plurality of studs being attached to an area of the upper channel at one end and attached to an area of the lower channel at another end; and a second plurality of studs, the each stud of the second plurality of studs being attached at one end to c), the each stud of the second plurality of studs being attached at another end to f).

In another aspect of the present invention, a layered panel comprises: a first layer having a first surface disposed at the front side of the panel and a second opposing surface being disposed on an inside of the panel, the first layer also comprising a top surface and a bottom surface; a second layer having a first surface in contact with the second surface of the first layer and a second opposing surface being disposed on an inside of the panel, the second layer also comprising a top surface and a bottom surface; a third layer having a first surface disposed at the rear side of the panel, a second opposing surface being disposed on an inside of the panel, the second surface of the third later being in contact with the second opposing surface of the second layer; an upper channel containing a) a first plate, b) a first vertical member attached to a first longitudinal side of the first plate, the b) being downwardly disposed, and c) a second vertical member attached to a second longitudinal side of the first plate, the c) being downwardly disposed, b) being embedded in the first layer, c) being embedded in the second layer, the first plate overlaying a portion of the top surface of the first layer and a portion of the top surface of the second layer; and a lower channel containing a d) second plate, e) a first vertical member attached to a first longitudinal side of the second plate, e) being upwardly disposed, and f) a second vertical member attached to a second longitudinal side of the second plate, f) being upwardly disposed, e) being embedded in the first layer, f) being embedded in the second layer, the second plate overlaying a portion of the bottom surface of the first layer and a portion of the bottom surface of the second layer.

In yet another aspect of the present invention, a process for manufacturing a layered panel of comprises: providing an open-top container having a bottom, a first side wall and an opposing second side wall; providing a reinforcing assembly; pouring wet concrete into the bottom of the container such as to form a layer of concrete of predetermined thickness; placing the reinforcing assembly inside the container in a manner such that the first plate is disposed against the first side wall of the container, such that the second plate is disposed against the second side wall of the container, such that the first vertical member attached to a first longitudinal side of the first plate is disposed at a midpoint of the concrete layer thickness inside the concrete and the second vertical member attached to a second longitudinal side of the first plate is disposed at a midpoint of the concrete layer thickness inside the concrete; setting the wet concrete layer such that the concrete fully hardens; placing the third layer in suspension above the container; placing the second layer inside the container, the second layer interfacing with the first layer such that the second plurality of studs, the second vertical member attached to the second longitudinal side of the first plate and second vertical member attached to the second longitudinal side of the second plate are disposed inside the second layer; and placing the third layer over the second layer, the third layer interfacing with the second layer.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

It is the object of the present invention to provide for a composite panel structure generally used in construction that has a high R value, high compression strength, high tensile strength and high bending stiffness.

FIGS. 1-11 describe three embodiments of the composite panel structure of the present invention. The first embodiment 10 is represented by FIGS. 1, and 4A and 5-7. The second embodiment 20A is described in FIGS. 2A, 2B, 4B, 5-7 and 10. The third embodiment 20B is shown by FIGS. 2B, 3B, 4B and 5-7. The first embodiment relates to standard building panel structures, while the second and the third embodiments represent reinforcement structures.

Figure 8A:
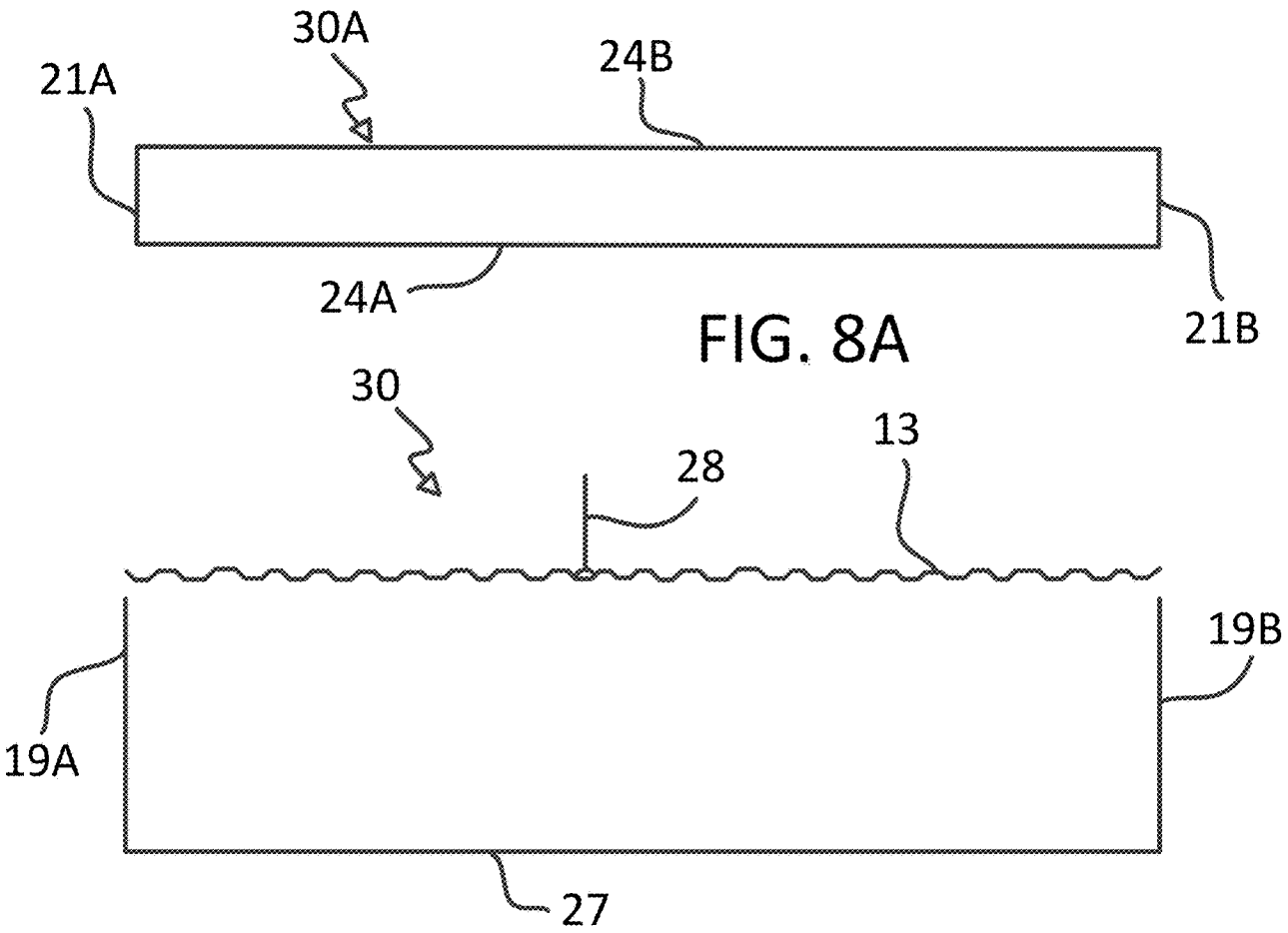
FIG. 8A is an illustration of the manufacturing process setup for the building panel of the second embodiment.
Figure 8B:
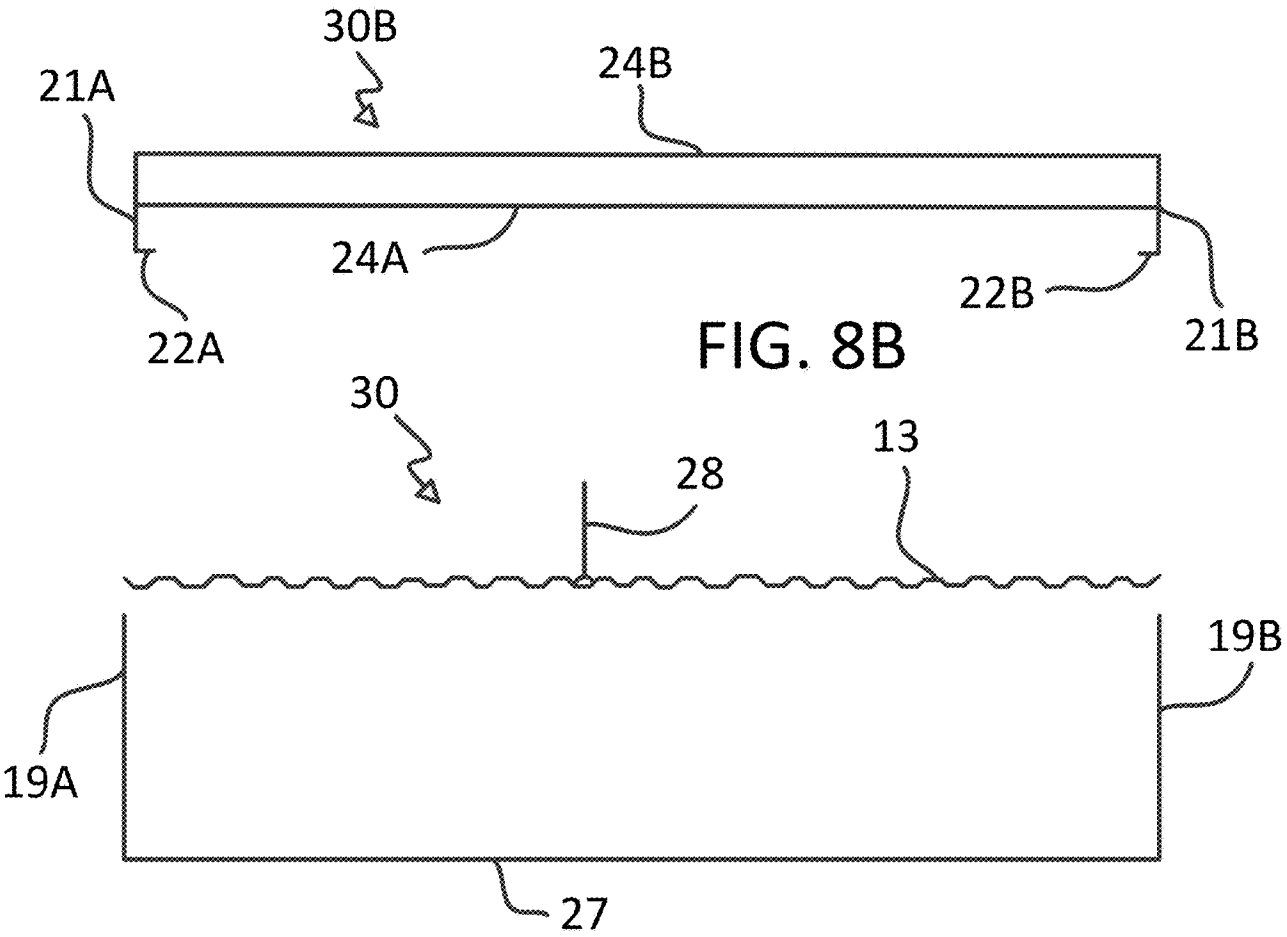
FIG. 8B is a portrayal of the manufacturing process setup for the building panel of the third embodiment.
Figure 9A:
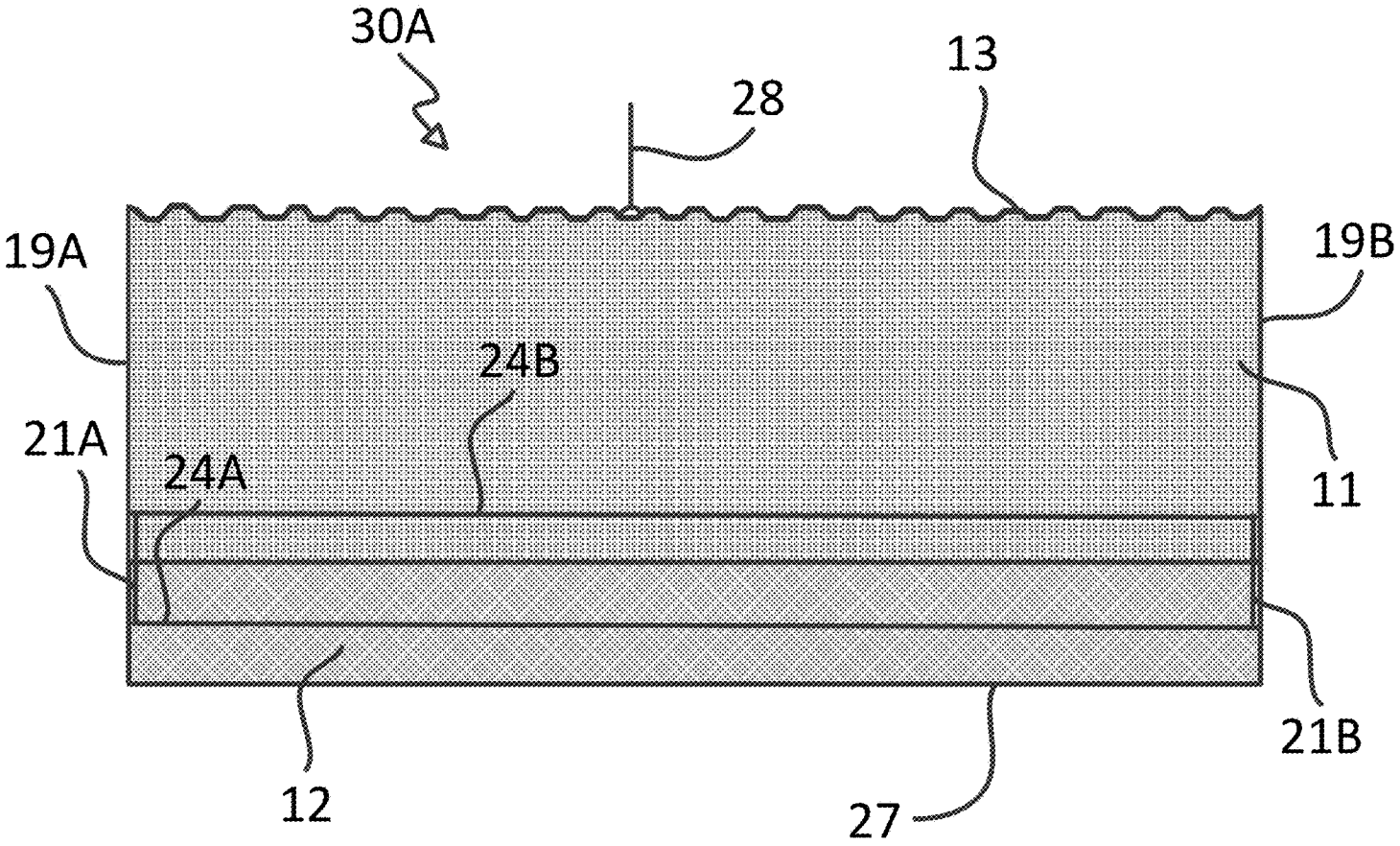
FIG. 9A portrays the building panel of the second embodiment at the completion of the manufacturing process in a cross sectional side view.
Figure 9B:
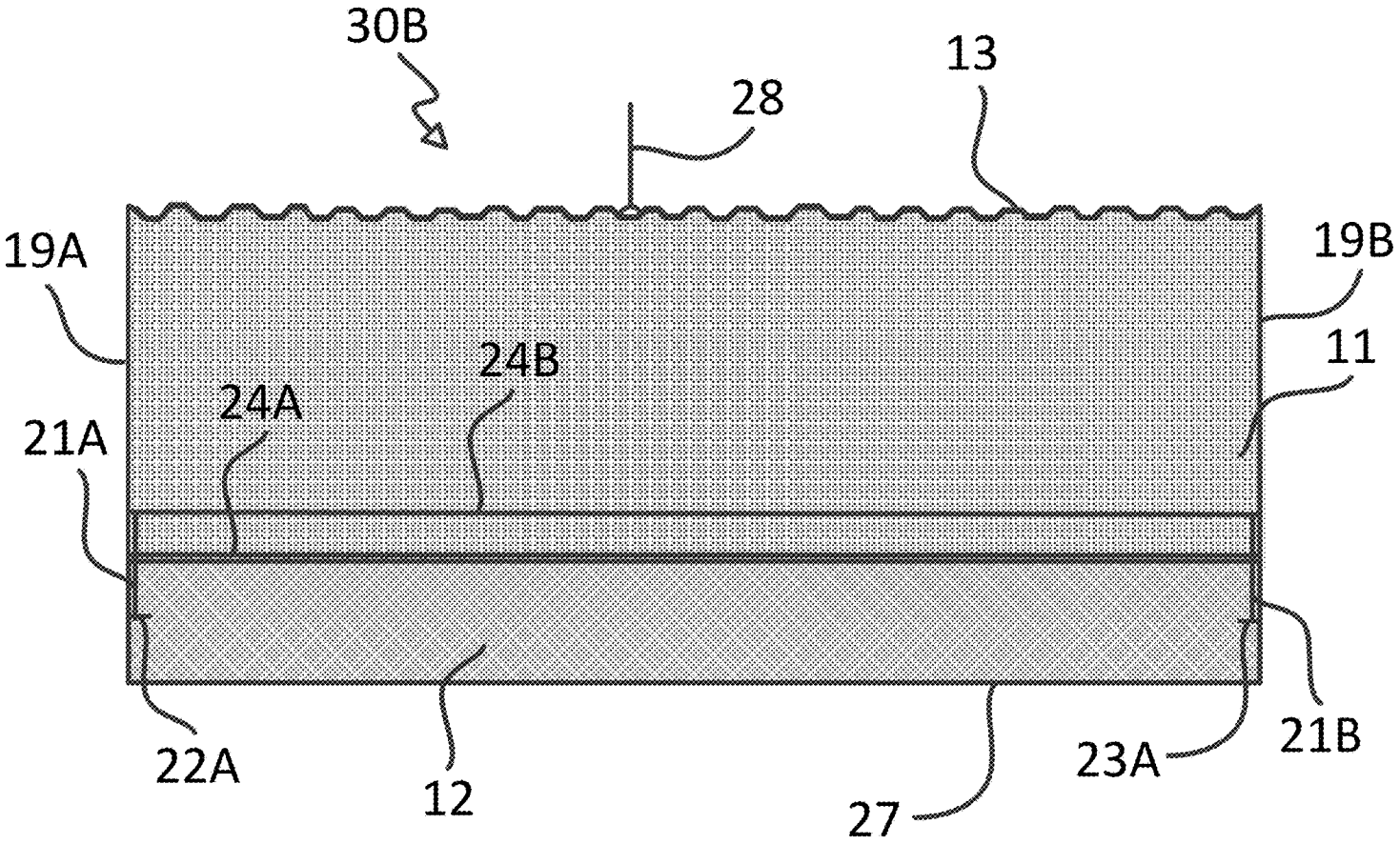
FIG. 9B illustrates the building panel of the third embodiment at the completion of the manufacturing process in a cross sectional side view.

FIGS. 8A and 9A illustrate the process of manufacturing 30A of the second embodiment composite panel 20A, while FIGS. 8B and 9B show the process of manufacturing 30B of the third embodiment panel 20B of the present invention.

Figure 1:
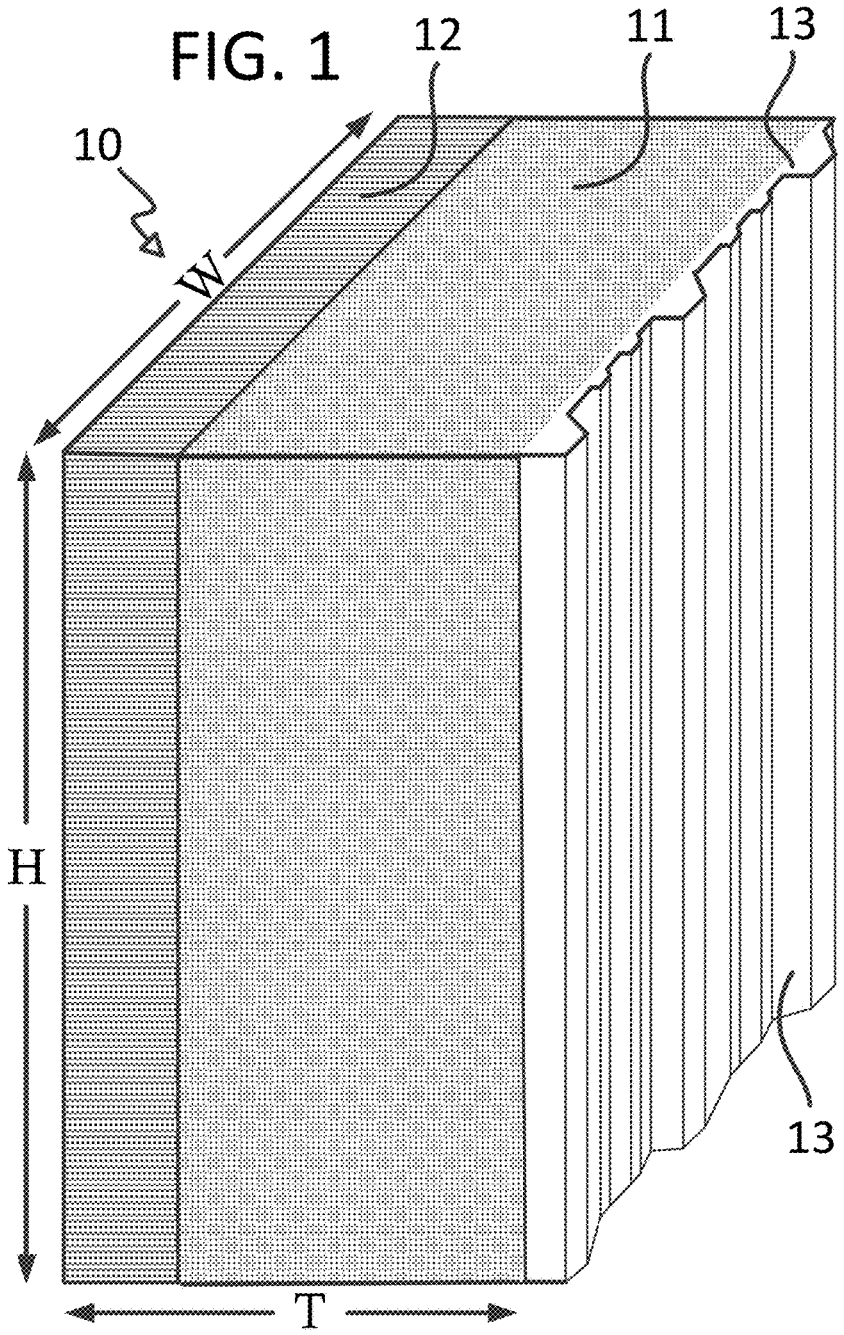
FIG. 1 shows a perspective side view of a building panel according to a first embodiment of the present invention.

In FIG. 1 representing the first embodiment of the panel, the composite panel 10 contains a layer made of concrete 12, an insulation layer 11, and a corrugated layer 13. The shape of the concrete layer is generally rectangular with the top surface being substantially parallel with the bottom that is disposed on the ground and the sides being vertical in relation to the ground. Likewise, the shape of the insulation layer is generally rectangular with the top surface being substantially parallel with the bottom that is disposed on the ground and the sides being vertical in relation to the ground.

The concrete is made of a specific formulation that maximizes the compression strength of the structures. The composition may contain silicon oxide, aluminum oxide, iron oxide, calcium oxide, magnesium oxide and sulfur trioxide in varying proportions. However, other component materials for the concrete also fall within the scope of the present invention.

The insulating material is, preferably, polyurethane; however, other insulating materials also fall within the scope of the present invention.

Figure 7:
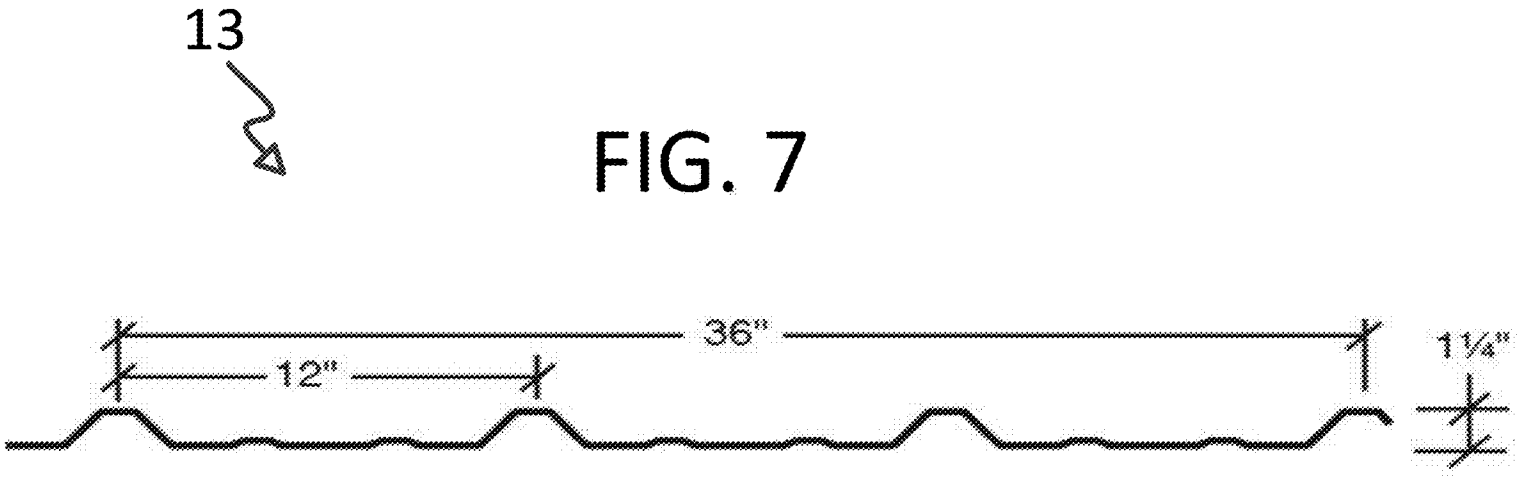
FIG. 7 is a top view of a component of the building panel according a first, a second and a third embodiment of the present invention.

The corrugated sheet layer 13 is preferably made of steel. A range of different thicknesses is suitable for the corrugated sheet. An exemplary corrugated panel configuration and dimensions are shown in FIG. 7; however, other panel configurations and dimensions also fall within the scope of the present invention.

Figure 2A:
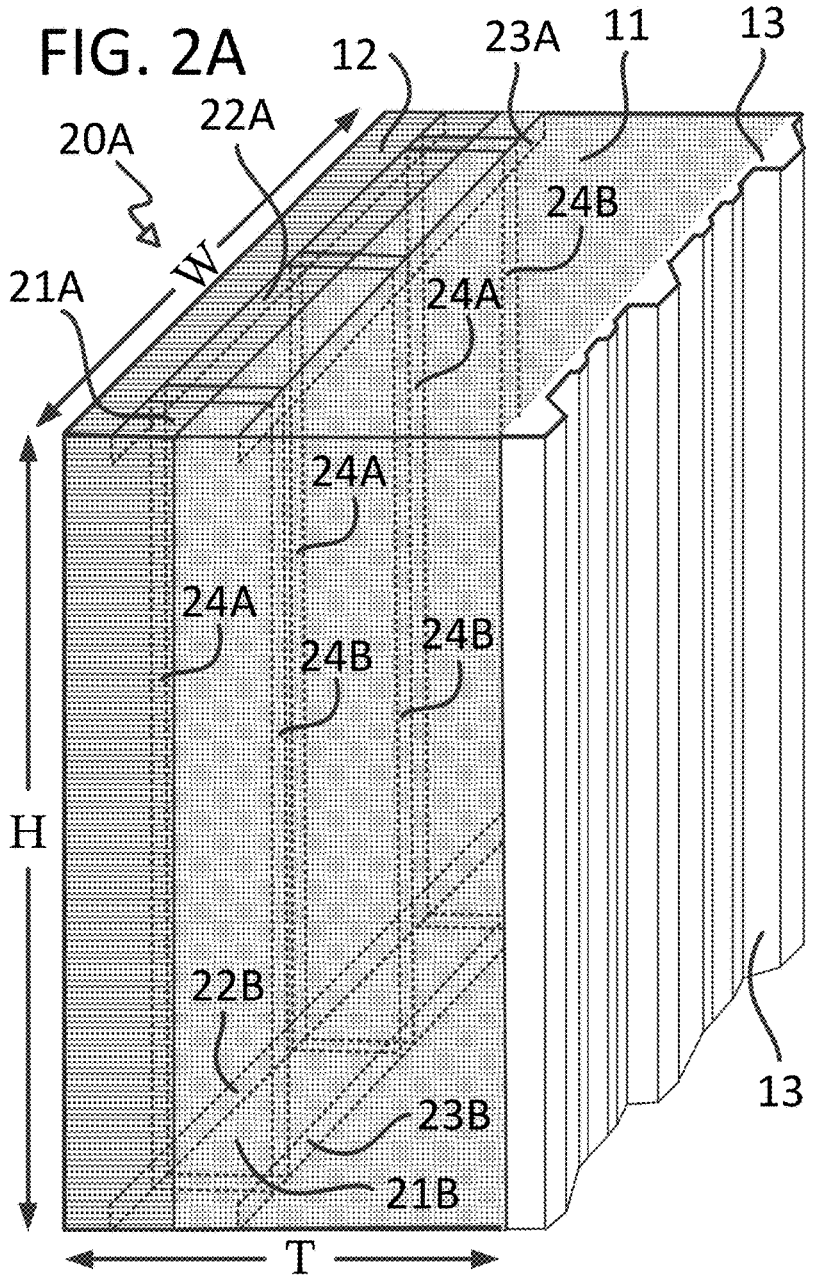
FIG. 2A is a cross sectional perspective side view of the building panel according to a second embodiment of the present invention.
Figure 2B:
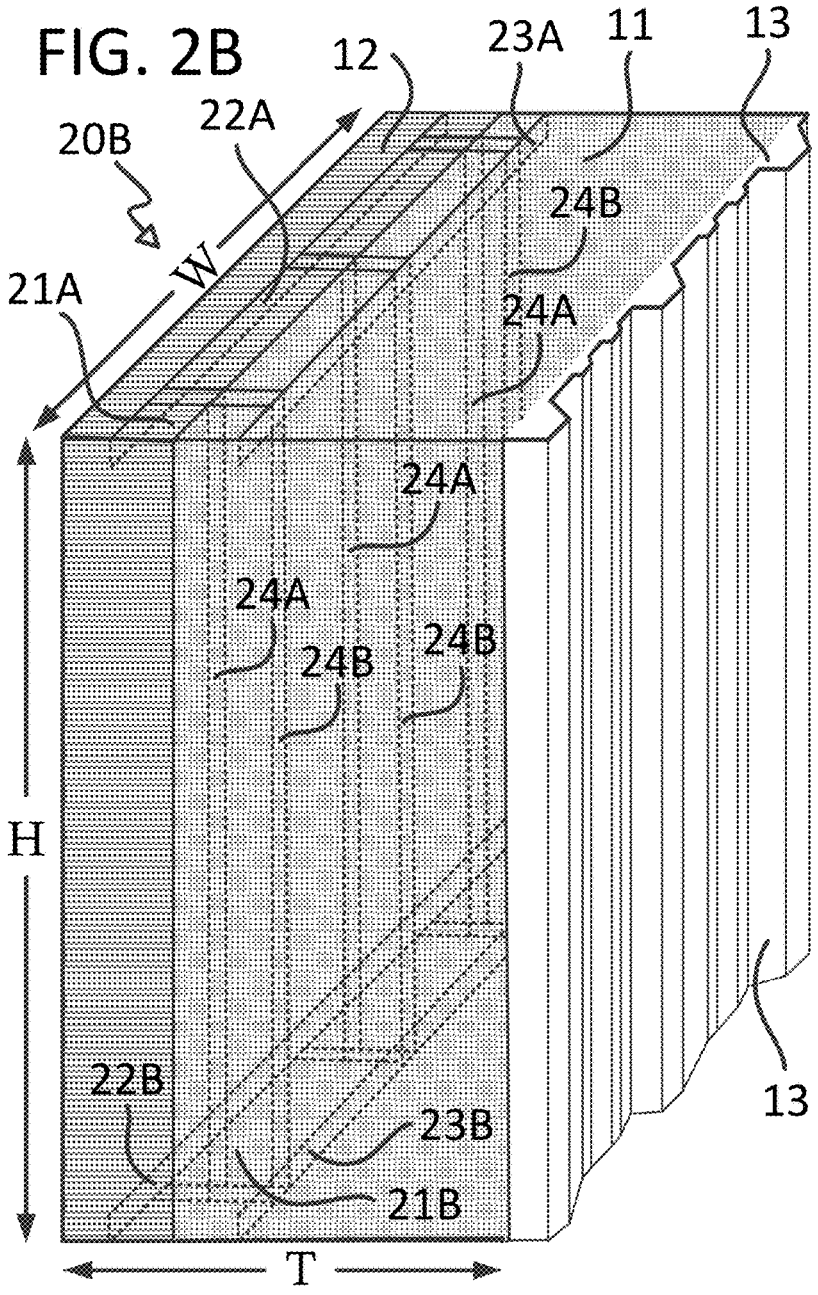
FIG. 2B is a cross sectional perspective side view of the building panel according to a third embodiment of the present invention.
Figure 3A:
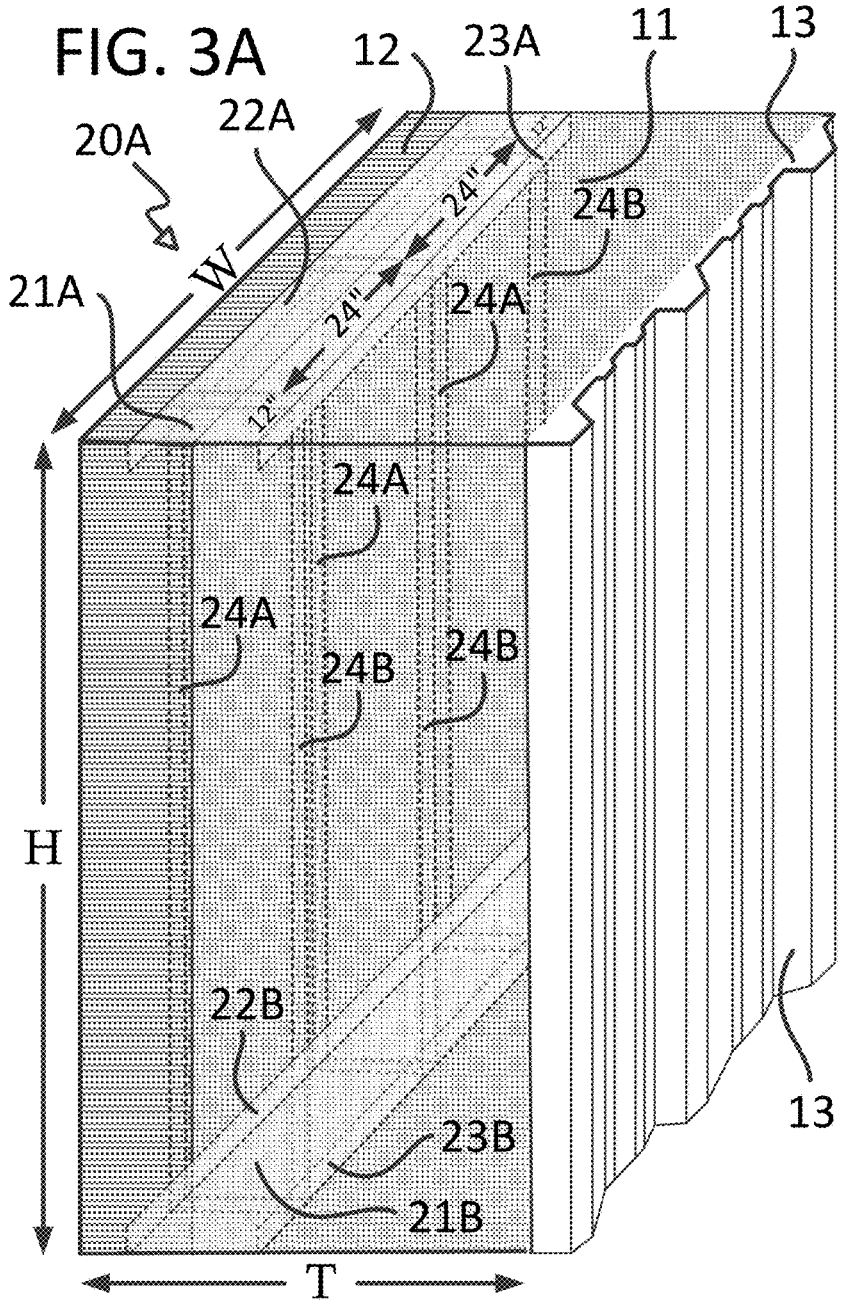
FIG. 3A is a different illustration of FIG. 2A.
Figure 3B:
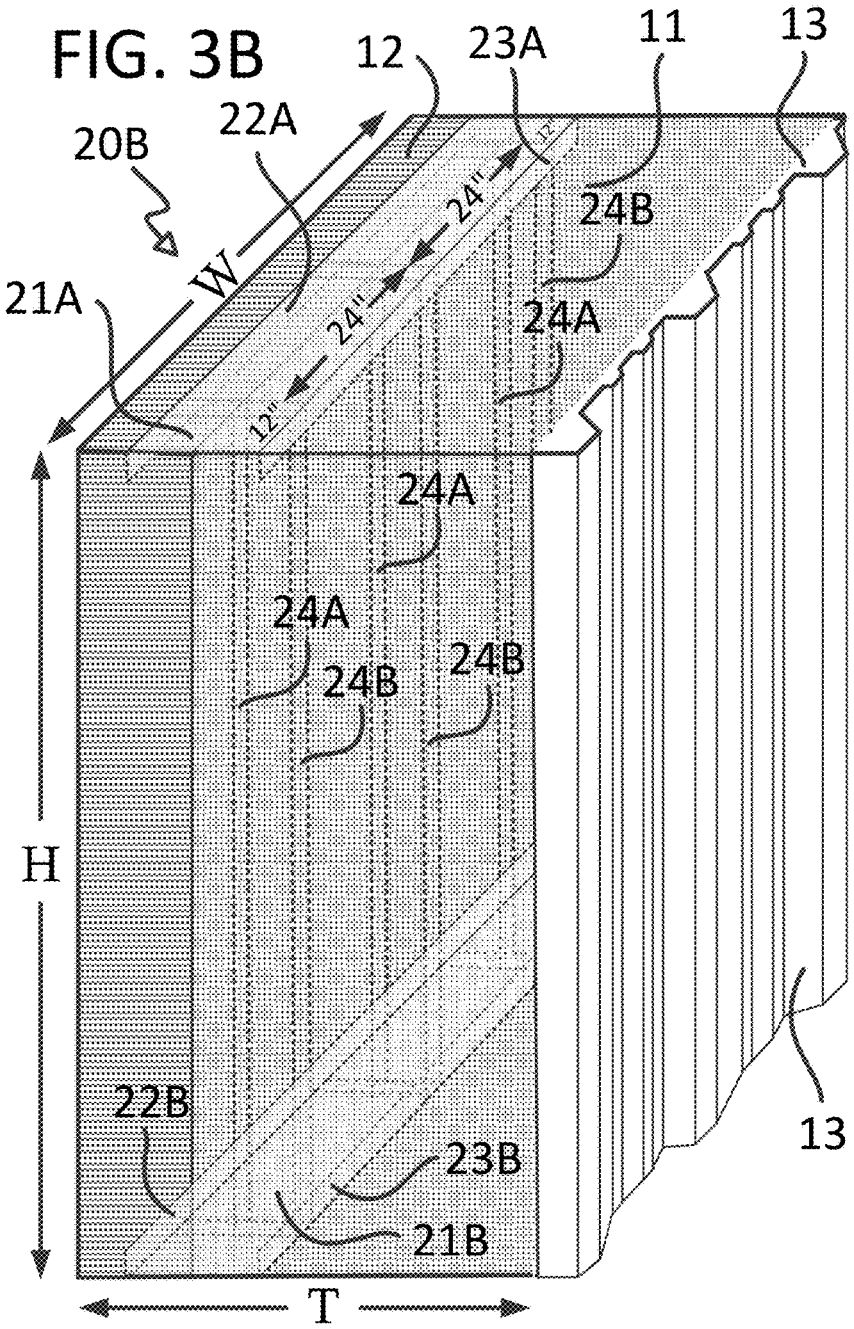
FIG. 3B is a different illustration of FIG. 2B.
Figure 4A:
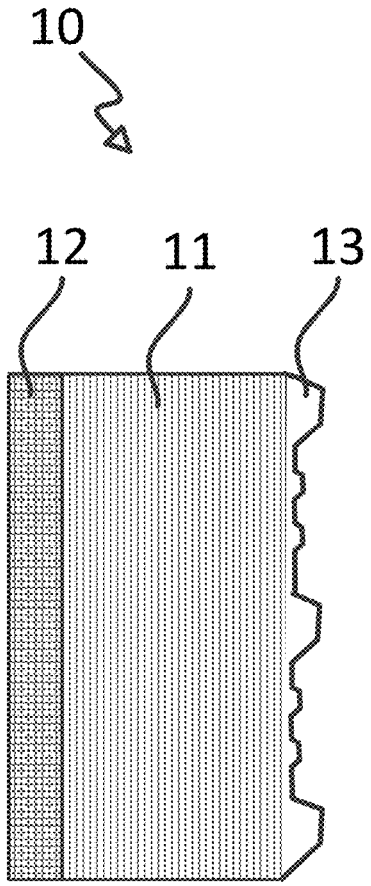
FIG. 4A is a top view of a building panel according to a first embodiment of the present invention.
Figure 4B:
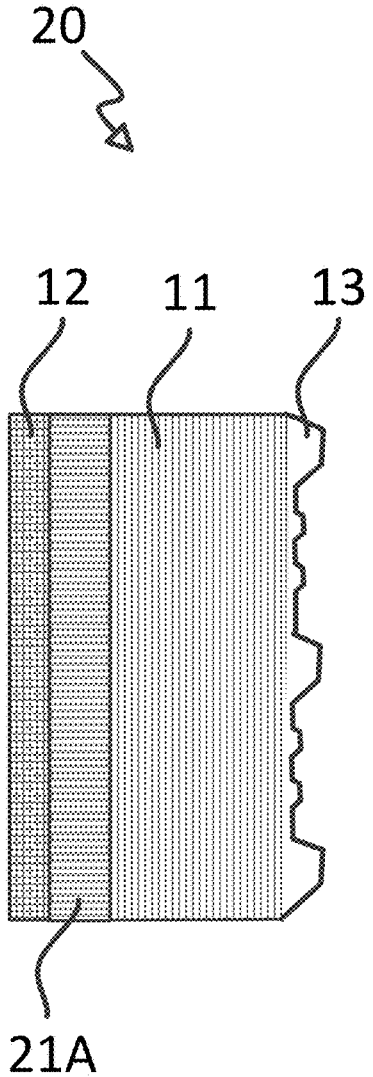
FIG. 4B is a top view of a building panel according to a second and a third embodiment of the present invention.
Figure 5:
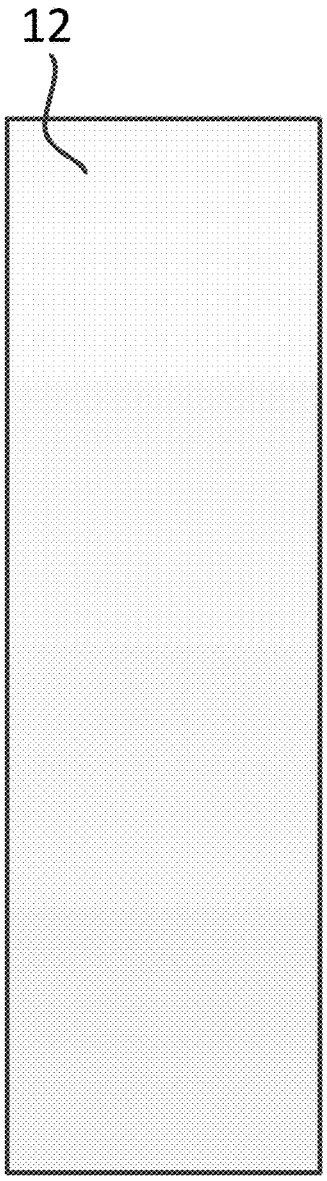
FIG. 5 represents a front and rear view of a building panel according to a first, second and third embodiment of the present invention.
Figure 6:
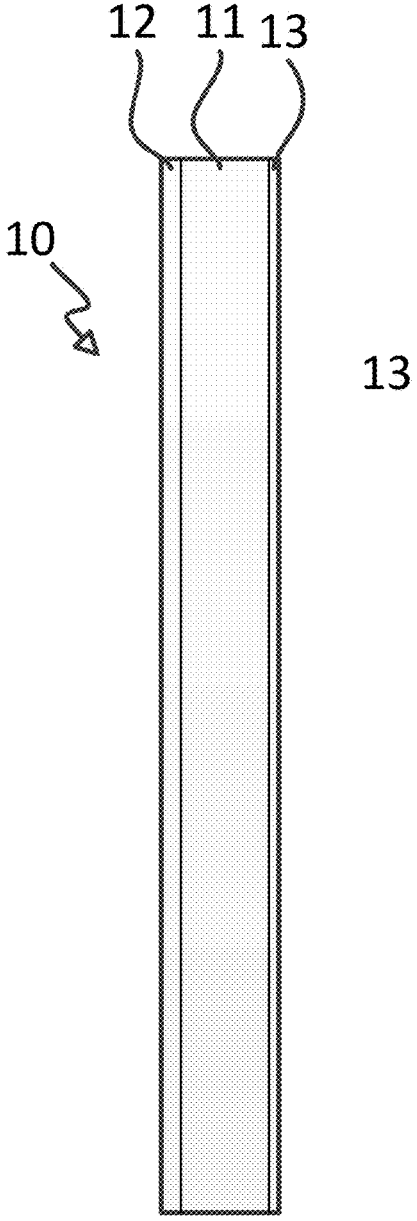
FIG. 6 depicts a side view of a building panel according to a first, a second and a third embodiment of the present invention.

The second embodiment of the present invention combines the first embodiment panel with a reinforcing assembly that is integrated with the panel. The reinforcing assembly has an upper channel that contains a first plate 21A that has two vertical members, 22A and 23A attached to the first plate 21A at their long sides in the width direction. As shown by FIGS. 2A and 3A, the first plate 21A interfaces with a portion of the top surface of the concrete layer and a portion of the top surface of the insulating layer. The first vertical member 22A is downwardly disposed in relation to the first plate 21A and is embedded in the concrete while the second vertical member 23A is downwardly disposed in relation to the first plate 21A and is embedded in the insulating layer. The reinforcing assembly also has a lower channel that contains a second plate 21B that has two vertical members, 22B and 23B attached to the second plate 21B at their long sides in the width direction. The second plate 21B covers a portion of the bottom surface of the concrete layer and a portion of the bottom surface of the insulating layer. The first vertical member 22B attached to the second plate 21B is upwardly disposed in relation to the second plate and is embedded in the concrete layer while the second vertical member 23B is upwardly disposed in relation to the second plate 21B and is embedded in the insulating layer.

The channels are made of steel; however, other materials of construction also fall within the scope of the present invention.

A plurality of studs 24 are attached to and connect vertical members 22A, 22B, 23A and 23B. As shown in FIGS. 2A and 3A representing the second embodiment of the layered panel, three studs 24A are attached to vertical member 22A at one end and to vertical member 22B at the other end. Studs 24A are all embedded in the concrete layer 12. Another three studs 24B are attached to vertical member 23A at one end and to vertical member 23B at the other end. These studs are all embedded in the insulation layer 11. In an embodiment of the present invention, the studs are spaced 24" apart in the center and 12" from each end of the insulation layer 11 and concrete layer 12 of the panel 20. However, other spacing distances fall within the scope of the present invention. The studs are about 1" to about 2" wide and preferably made of steel; however, other materials of construction also fall within the scope of the present invention. The channel and stud structure reinforce the panel 20, but because they are not exposed to the outer side of the panel or the inside of the panel, they do not contribute to heat or cooling conduction and losses to the outside.

One negative of the structure of the second embodiment is that embedding studs 24A in the concrete layer may create cracks and weak areas in the concrete if the thickness of the concrete layer is in the range of 2". Cracking the concrete is less likely if the thickness of the concrete layer is higher, e.g., 4 inches. In the third embodiment of the present invention, studs 24A are attached to a midpoint of the bottom surface of the first plate at one end, and to a midpoint of the upper surface of the second plate at their other end. With this configuration, the studs 24A are not embedded in the concrete, but are disposed at the interface between the concrete layer and the insulating layer. This placement of the studs may be used if the thickness of the concrete layer is around 2".

Figure 10:
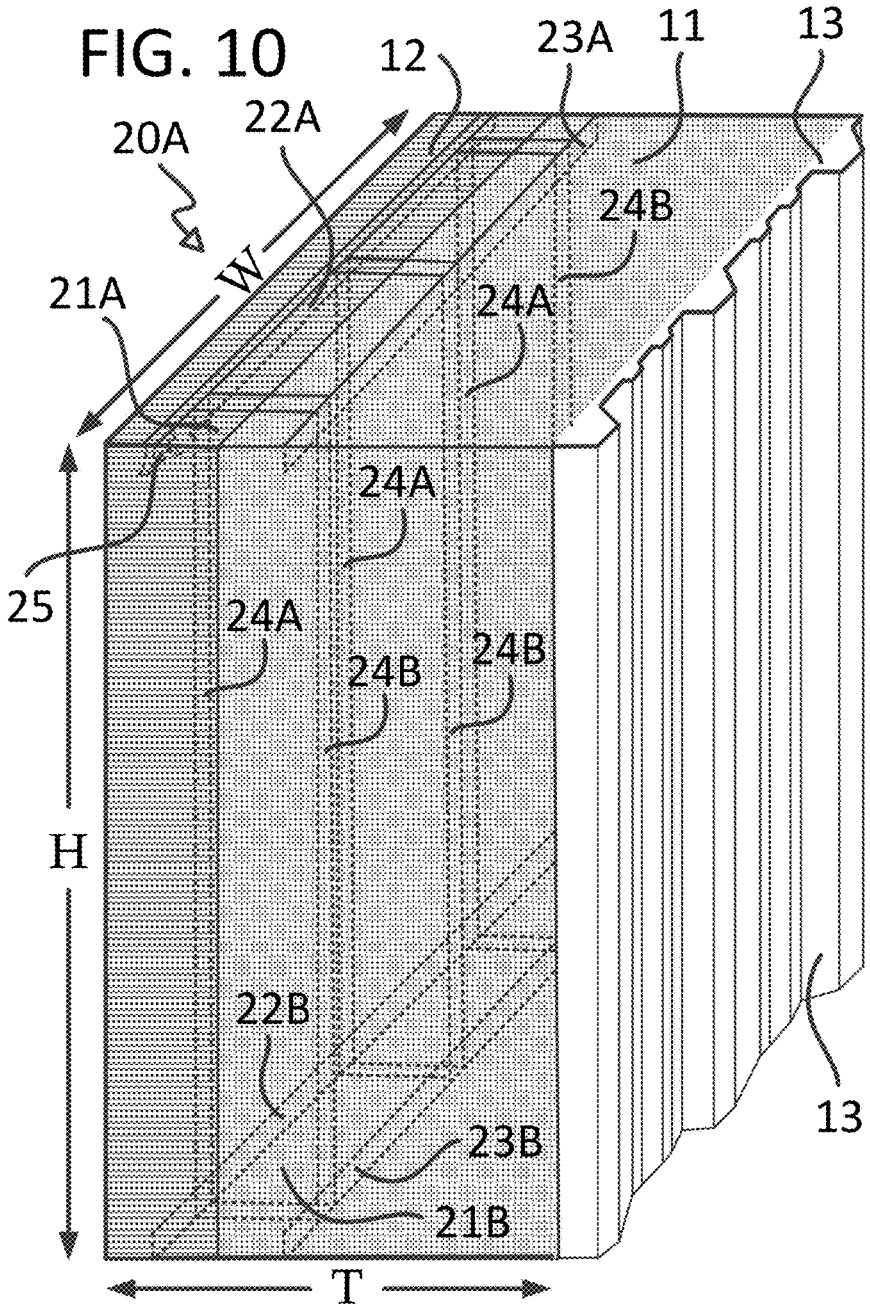
FIG. 10 portrays a variation of the second the panel structure embodiment of the present invention in a perspective cross sectional side view.
Figure 11:
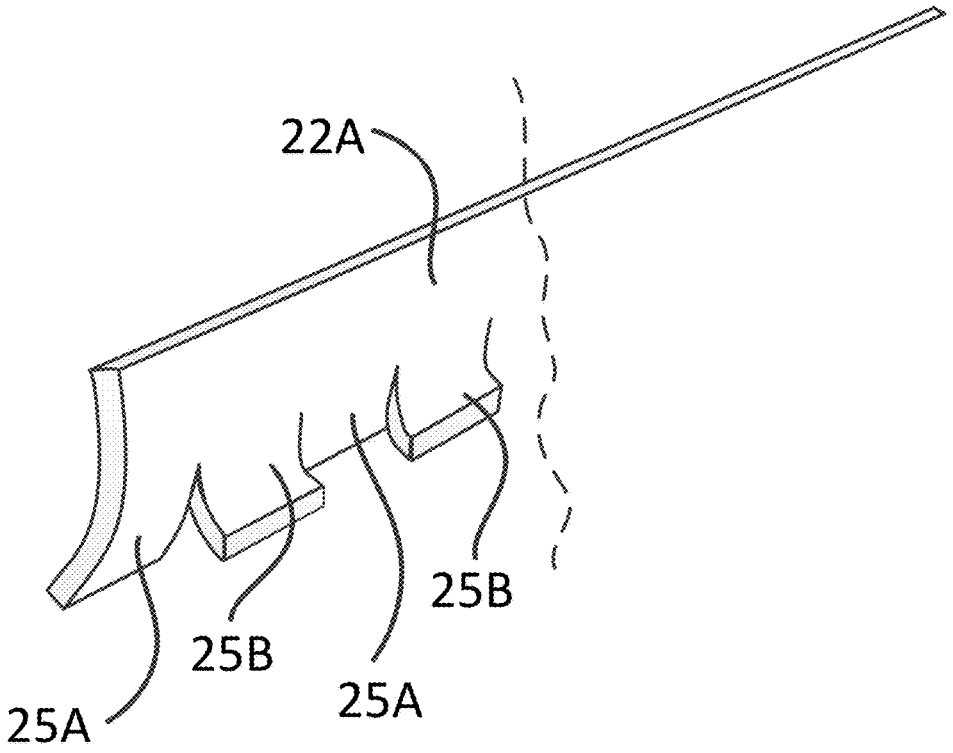
FIG. 11 is a close-up view of a component of FIG. 10.

In a variation of the second embodiment, the bottom portions of vertical members 22A and 22B embedded in the concrete layer are sheared and bent to the sides. This is shown in FIGS. 10 and 11. The shear bent extensions 25A and 25B of the vertical members alternate from side to side and provide additional resistance to the panel against shear forces.

The panel composite is manufactured in a way that the polyurethane layer strongly adheres to the concrete layer on one side and to the corrugated layer on the other side. The structure of this panel solves the problem of building a high R value into the panel while also providing structural integrity to the panel such as resistance to shearing and buckling as a result of the impact of high winds or other lateral forces. To achieve the strong adherence of the insulation layer to the concrete and corrugated layers, the insulation layer is formed in situ by reacting the components for forming the polyurethane insulation in the space between the concrete and the corrugated layers.

Exemplary dimensions for the panel composite and its components are as follows:

The height (H) of the composite panel depends on the building specifications and may range from 1' to 50'.

The thickness of the concrete layer: 2" and ranging from 2" to 6".

The thickness of the insulation layer: 4.75" with a range of 2" to 10"

The highest thickness of the corrugated steel: gauge 26 to 2×gauge 22.

The thickness of the composite panel (T): 8" with a range of between 5.5" and 18".

The width (W) of the panel is 6' with a range of 6' to 12'.

The manufacturing process for the first embodiment of the composite panel is as follows:

1. The concrete is poured into the bottom of an open top enclosure sufficiently large to contain the full panel.

2. After the concrete is set, the corrugated layer is suspended above the enclosure by hoist in a way as to allow for the proper space between the concrete and the corrugated layer.

3. A heavy lid is placed onto the enclosure to contain the pressure that would result from the reaction to form the polyurethane insulation layer.

4. The liquid ingredients that react to produce the solid polyurethane layer are injected into the enclosure. The reaction is typically accomplished by mixing a diisocyanate with a polyol at about 80° F. The reaction takes place in the space between the concrete and corrugated sheet.

5. Once fully formed, the solid polyurethane bonds to both the concrete and corrugated layers.

The steps for manufacturing the panel of the second embodiment are as follows:

1. An open top container that has dimensions to accommodate the panel is provided such that the front of the concrete layer lays on the bottom of the container, one side wall of the container faces the top of the panel while the other side wall of the container faces the bottom of the panel structure.

2. Wet concrete is poured into the container in the dimensions of the concrete layer.

3. While the concrete is still wet, the second embodiment reinforcing assembly is inserted in the wet concrete such that studs 24A are embedded inside the concrete layer at about a mid-point of the concrete thickness. Likewise, vertical members 22A and 22B are also embedded in the concrete at about a mid-point of the concrete thickness.

4. The concrete is allowed to harden.

5. The corrugated layer is suspended above the enclosure by hoist in a way as to allow for the proper space between the concrete and the corrugated layer.

6. A heavy lid is placed onto the enclosure to contain the pressure that would result from the reaction to form the polyurethane insulation layer.

The polyurethane insulation layer may be formed in two ways as follows:

A. As with the process for making the first embodiment panel, the reactants needed to form the polyurethane layer are injected into the space between the concrete and corrugated layer and are reacted. This forms a solid polyurethane layer wedged between the concrete and corrugated layer such that the solid polyurethane is bonded to both the concrete and corrugated layers. Injection of the reactants maybe injected through openings in the side walls of the container. This produces an intensely exothermic reaction such that the resulting heat and pressure must be contained.

B. With a second process, the reactants for forming the insulation layer are introduced through the open top of the container. After the reactants are introduced into the container, the lid is placed over the top opening to create the closed environment needed for the reaction to take place.

The process for manufacturing the panel of the third embodiment is similar to the process of manufacturing the second embodiment panel except that the reinforcing assembly of the third embodiment is used, resulting in studs 24A being disposed at the interface between the concrete and insulation layers. However, vertical members 22A and 22B are embedded in the concrete at about a mid-point of the concrete thickness.

It should be understood, of course, that the foregoing relates to exemplary embodiments of the invention and that modifications may be made without departing from the spirit and scope of the invention.

I claim:

1. A reinforcing assembly for a wall panel structure, said reinforcing assembly comprising:

an upper channel containing a) a first plate, b) a first vertical member attached to a first longitudinal side of said first plate and being downwardly disposed, and c) a second vertical member attached to a second longitudinal side of said first plate and being downwardly disposed;

a lower channel containing d) a second plate, e) a first vertical member attached to a first longitudinal side of said second plate and being upwardly disposed, and f) a second vertical member attached to a second longitudinal side of said second plate and being upwardly disposed;

a first plurality of studs, each said stud of the first plurality of studs being attached to an area of the upper channel at one end and attached to an area of the lower channel at another end; and a second plurality of studs, each said stud of the second plurality of studs being attached at one end to the second vertical member of the upper channel, said each stud of the second plurality of studs being attached at another end to the second vertical member of the lower channel, wherein said each stud of the first plurality of studs is attached at the one end to the first vertical member of the upper channel and attached to the first vertical member of the lower channel at the another end, wherein the first plurality of studs is embedded in a concrete layer of the wall panel structure, said concrete layer having a top surface and a bottom surface, said concrete layer interfacing laterally with an insulating layer, the insulating layer having a top surface and a bottom surface, wherein the second plurality of studs is embedded in the insulating layer, wherein the first plate interfaces with a portion of the top surface of the concrete layer and with a portion of the top surface of the insulating layer and wherein the second plate interfaces with a portion of the bottom surface of the concrete layer and interfaces with a portion of the bottom surface of the insulating layer;

wherein the first vertical member of the upper channel and the first vertical member of the lower channel are embedded in the concrete layer; and wherein the second vertical member of the upper channel and the second vertical member of the lower channel are embedded in the insulating layer.

2. The reinforcing assembly of claim 1, wherein said each stud of the first plurality of studs is attached at the one end to a bottom mid-point of the first plate and is attached at the another end to a mid-point upward facing surface of the second plate.

3. The reinforcing assembly of claim 2, wherein the first plurality of studs is disposed at an interface between the concrete layer of the wall panel structure and the insulating layer of the wall structure.

4. The reinforcing assembly of claim 1, wherein a bottom end of the first vertical member of the upper channel contains a plurality of shear bending extensions.

5. The reinforcing assembly of claim 4, wherein said shear bending extensions alternate from one side of the first vertical member of the upper channel to another side thereof.

6. The reinforcing assembly of claim 1, wherein an upper end of the first vertical member of the lower channel contains a plurality of shear bending sections.

7. The reinforcing assembly of claim 4, wherein the shear bending sections alternate from one side of the first vertical member of the lower channel to another side thereof.

8. A process for manufacturing a layered panel comprising:

providing an open-top container having a bottom, a first side wall and an opposing second side wall;

providing the reinforcing assembly of claim 1;

pouring wet concrete into the bottom of the container such as to form the concrete layer of predetermined thickness;

placing the reinforcing assembly inside the container in a manner such that the first plate is disposed against the first side wall of the container, such that the second plate is disposed against the second side wall of the container, such that the first vertical member attached to the first longitudinal side of said first plate is disposed at a midpoint of the concrete layer thickness inside the wet concrete and the second vertical member attached to the second longitudinal side of said first plate is disposed at the midpoint of the concrete layer thickness inside the wet concrete;

setting the concrete layer such that the wet concrete fully hardens;

placing a third layer in suspension above the container;

forming the insulating layer inside the container, said insulating layer interfacing with the concrete layer such that the second plurality of studs, the second vertical member attached to said second longitudinal side of the first plate and second vertical member attached to the second longitudinal side of the second plate are disposed inside the insulating layer; and placing the third layer over the insulating layer, said third layer interfacing with the insulating layer.

9. The process of claim 8, wherein the third layer is made of corrugated steel material.

10. The process of claim 8, wherein the insulating layer comprises a polyurethane insulating material.

11. The process of claim 8, wherein forming the insulating layer is accomplished by reacting a mixture of diisocyanate and polyol at about 80° F., said mixing causing a reaction to occur, the reaction being carried out in a confined space to contain excessive pressure release produced by the reaction, the diisocyanate and polyol being injected through the side walls of the container, said reaction producing polyurethane.

12. The process of claim 8, wherein the insulating layer is made by mixing a diisocyanate with a polyol, said diisocyanate and polyol being introduced into the container over the concrete layer.

* * * * *